US009643701B2

(12) United States Patent
Dokonal

(10) Patent No.: US 9,643,701 B2
(45) Date of Patent: May 9, 2017

(54) FOLDING BOWSPRIT

(71) Applicant: Jindrich Dokonal, Saratoga, CA (US)

(72) Inventor: Jindrich Dokonal, Saratoga, CA (US)

( * ) Notice: Subject to any disclaimer, the term of this patent is extended or adjusted under 35 U.S.C. 154(b) by 0 days.

(21) Appl. No.: 14/168,006

(22) Filed: Jan. 30, 2014

(65) Prior Publication Data

US 2016/0332713 A1 Nov. 17, 2016

Related U.S. Application Data

(60) Provisional application No. 61/765,269, filed on Feb. 15, 2013.

(51) Int. Cl.
*B63H 9/10* (2006.01)

(52) U.S. Cl.
CPC ..... *B63H 9/10* (2013.01)

(58) Field of Classification Search
CPC ..... B63H 9/10
USPC ..... 114/89
See application file for complete search history.

(56) References Cited

U.S. PATENT DOCUMENTS 1,891,555 A * 12/1932 Rockwood ..... B63B 15/00 114/39.21
3,141,435 A * 7/1964 Moffitt, Jr. ..... B63B 1/121 114/39.26
4,940,008 A * 7/1990 Hoyt ..... B63B 15/02 114/39.21
5,243,924 A * 9/1993 Mann ..... B63B 13/00 114/344
6,647,917 B1 * 11/2003 Hoyt ..... B63B 15/00 114/343
6,857,380 B1 2/2005 Robinson
7,367,276 B2 5/2008 Ashdown
7,762,204 B2 * 7/2010 Smith ..... B63H 9/06 114/89

* cited by examiner

*Primary Examiner* — Stephen Avila
(74) *Attorney, Agent, or Firm* — Shifrin Patent Law; Dan Shifrin

(57) ABSTRACT

A folding bowsprit permits deployment of sails from a point forward of the bow on sailing vessels. The folding function allows the sprit to rotate around an axis at ninety degrees to the vessels centerline and permits the end of the sprit to move vertically up or down. This unique ability to fold facilitates: compact stowage when not in use and reduces the overall length of the vessel; adjustment of tack position vertically while sailing; and safer and simpler sail handling by accessing the tack point of said sprit within the deck footprint while sailing.

2 Claims, 4 Drawing Sheets

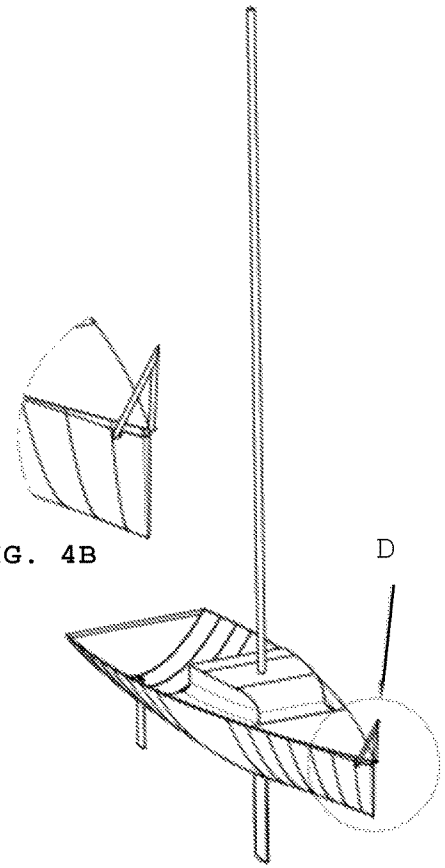
FIG. 4A
FIG. 4B
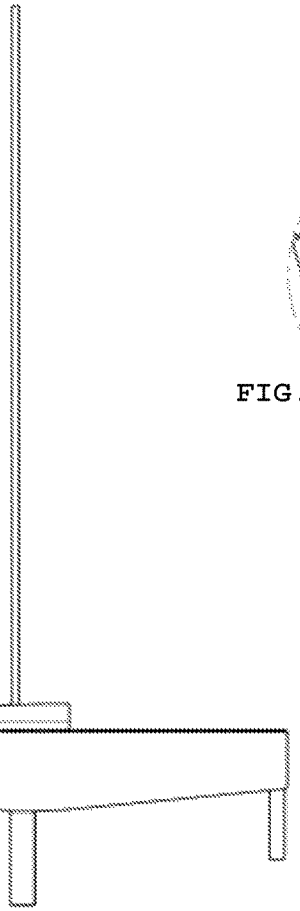
FIG. 6A
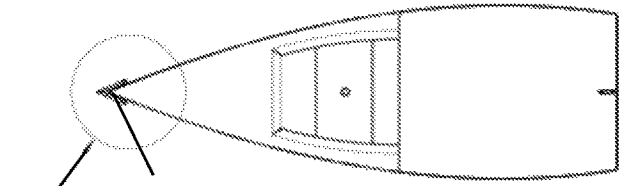
FIG. 5A
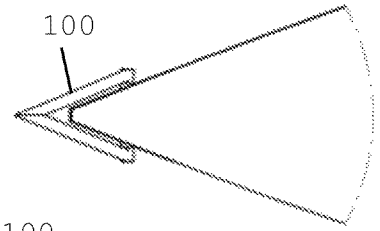
FIG. 5B
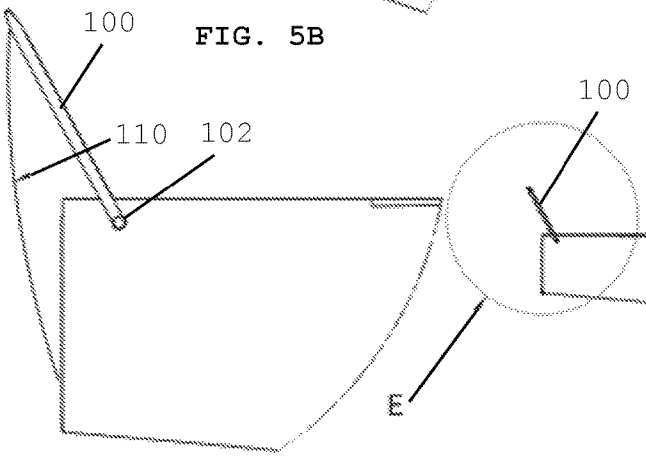
FIG. 6B

FOLDING BOWSPRIT

RELATED APPLICATION DATA

The present application claims the benefit of commonly-owned U.S. Provisional Application Ser. No. 61/765,269 entitled Folding Bowsprit, filed on the Feb. 15, 2013, which application is incorporated herein by reference in its entirety.

SPECIFICATION

Background

Modern sailboats 10 (FIG. 1) are re-inventing themselves in the never ending quest to become faster, safer and easier to handle. One common trend in sailboat design borrows a concept from yesteryear by utilizing a spar 12 mounted on the front (bow) 14 of a boat 10 to extend the tack point forward for the attachment of sails, this spar 12 is known as a bowsprit. This phenomenon is partly driven by contemporary designs having more vertical or plumb bows, than the sweeping lines of long overhangs typical in sailing vessels designed in the first half of the $20^{th}$ century. Modern designs tend to extend the waterline length to the extremities of the bow 14 and the stern 16, thus maximizing speed potential for a certain sized length over all (LOA). The market demands the fastest boat possible for a certain length as this dimension drives the overall cost of ownership, as monthly storage charges are based on LOA and various other ownership costs tend to be proportional to the LOA cubed.

With the evolution of plumb bows, sailors have forfeited the ability to deploy sails well forward of the mast 18, thereby compromising the sail forward of the mast 18. A reduction in forward sail-area also impacts the steering balance of the vessel 10. The further the tack point is in front of the mast 18, the larger is the area of the sail that can be deployed. Furthermore boat steering is enhanced and overall performance improved when the center of effort (which approximates to be the center of sail area) is well in front of the center of resistance (which approximates to be the center of displacement). This stabilizing concept is analogous to the vessel 10 being pulled through the water rather than pushed and requiring less corrective steering which is detrimental to speed.

Modern boats are capitalizing on the aforementioned beneficial characteristic by rediscovering this once forgotten spar 12, the bowsprit. The challenge therefore becomes how can modern boats capitalize on benefits of this forward protruding spar 12 without permanently being affected by it's encumbrances that escalate storage costs and general awkwardness.

Currently there are three concepts active in the marketplace attempting to solve this issue:

1. Permanent sprit reinforced by a bob-stay (a guy that angles back to the bow of the boat and attaches just above the waterline.
2. Telescoping sprit installed through the bow of the boat.
3. Telescoping sprit installed above deck and offset to avoid essential rigging.

Pros & Cons of Aforementioned Bowsprit Concepts:

Concept 1 simply extends the tack of the sail forward but does nothing to decrease the overall LOA when the boat is in a storage configuration; therefore storage is awkward and expensive. Remaining in a permanently protruded configuration is detrimental to maneuvering the vessel in tight quarters, and can be difficult or dangerous to service or adjust when the vessel is underway.

Concept 2 helps solve the storage issue by retracting into the vessels interior thus reducing the LOA but requires significant structural upgrading to handle the extremely high point loading configuration. Said concept has been integrated into the design of many contemporary boats; however there is a significant interference with space in the bow interior. Furthermore this configuration requires a large diameter hole facing directly forward into oncoming seas and leakage around this opening is common. No serious ocean going vessel would consider such a breach in the water-tightness of the vessel in this area. Retrofitting this configuration is expensive and complex due to the structural upgrade requirements. The loads developed in this cantilevered sprit are intense. From an engineering perspective this cantilevered bending mode is the least efficient means to carry a load as it results in a larger sectional requirement to limit deflection to an acceptable level. Consequently these sprits tend to be larger in diameter and heavier in weight than a comparable sprit supported by a bob-stay.

Concept 3 is similar to 2 except it is mounted above the deck and would seem to have the best of all worlds. In practice however the deck mounted telescoping spar develops extremely high point loads and requires significant structural upgrades prior to installation. Without a bob-stay, the loads are carried by cantilever and the spar is subjected to the issues illustrated for item 2. This configuration also creates deck clutter as it obstructs the foredeck area of the vessel. Sailing vessel deck space should remain clear and unfettered to permit the crew safe and easy access. Space at the bow is at an absolute premium and any small protrusion of hardware because a serious trip hazard when traversing this space in any sea condition. Another unfortunate aspect with this concept is that it is visually unappealing. A sailing boat's beauty is defined by it's vessels lines. Aesthetics tend to be compromised whenever appliances are installed at either end of a vessel that break or obstruct these natural lines. Lastly due to rigging configurations the forward stay (head stay) on a sailing vessel is always mounted on centerline, this is exactly the same location desired for a deck mounted retracting bowsprit. The compromise becomes an angled offset which adds to the overall awkwardness of the look installation and operation of this device. Adjustment or retrieval of any telescoping sprit is next to impossible while in the sailing mode due to the high lateral loading forces. This can result in complications in sail retrieval if accessing the tack point is required and in certain situations compound into a hazardous event.

PRIOR ART

Retractable bowsprit for sailboat—U.S. Pat. No. 7,367,276

Sailboat spinnaker bowsprit—U.S. Pat. No. 6,857,380

BRIEF DESCRIPTION OF THE DRAWINGS

FIG. 4A is an isometric view of the sail boat of FIG. 2A with the folding bow sprit in the folded/vertical position;

FIG. 4B is a close-up of detail D of FIG. 4A;

FIG. 5A is a side view of the sail boat of FIG. 4A;

FIG. 5B is a close-up view of detail E of FIG. 5A;

FIG. 6A is a top view of the sail boat of FIG. 5A;

FIG. 6B is a close-up view of detail C of FIG. 6A;

DETAILED DESCRIPTION OF THE PREFERRED EMBODIMENT

Figure 1:
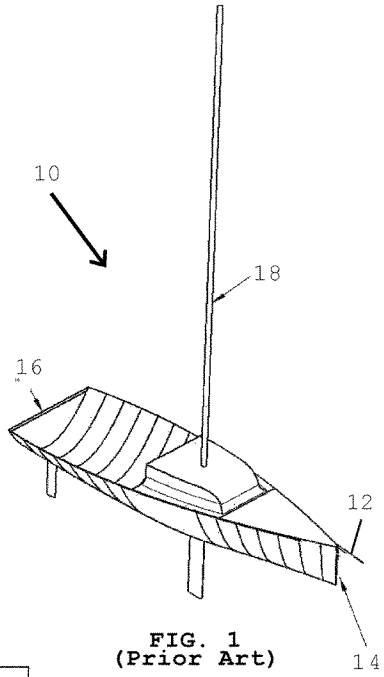
FIG. 1 (Prior Art)
FIG. 1 illustrates a prior art sail boat.
Figure 2A:
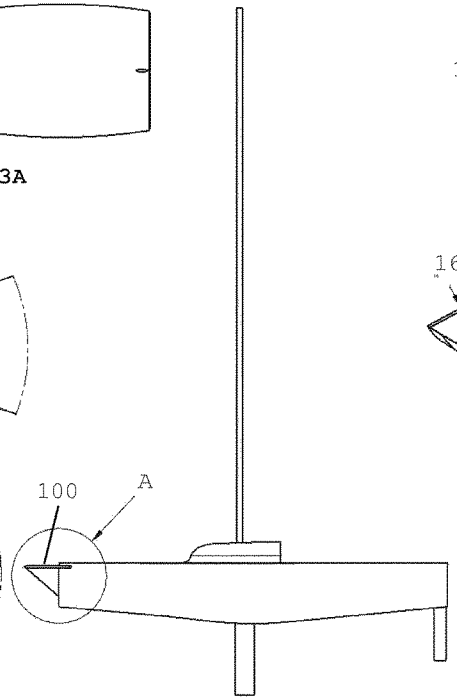
FIG. 2A is a side view of a sail boat incorporating an embodiment of the folding bow sprit of the present invention in the sailing/horizontal position.
Figure 3A:
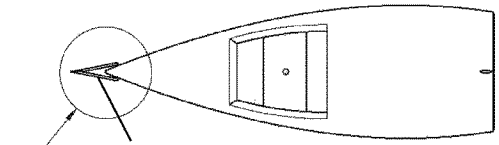
FIG. 3A is a top view of the sail boat of FIG. 2A.
Figure 3B:
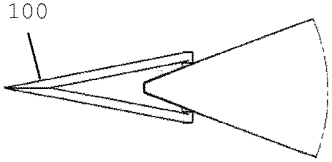
FIG. 3B is a close-up view of detail B of FIG. 2B.
Figure 2B:
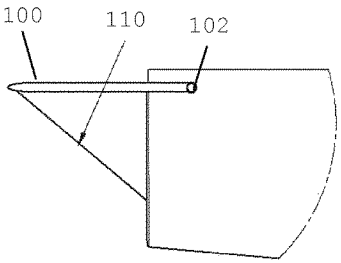
FIG. 2B is a close-up view of detail A of FIG. 2A.

The Folding Bowsprit 100 (FIGS. 2A-9B) is an adaptation of the traditional wooden bowsprit and is supported by a bob-stay 120 which has been in use on sailing vessels for centuries. The primary purpose of the bowsprit 100 is to maximize sail area deployment by extending the tack position further forward of the mast than as permitted by the constraints of a vessels deck. The secondary purpose of the sprit 100 is to provide a more balanced sail plan by moving the center of effort forward which in certain conditions reduces steering loads and improves overall sailing performance and speed.

The Folding Bowsprit 100 has an elegantly simple yet unique geometry similar in concept to a forward protruding wishbone. Said sprit 100 is pinned to the vessel via a hinge 102 installed just below the deck line near the bow. The axis of rotation permits movement from the horizontal position (when sailing) (FIGS. 2A-3B) to the vertical position (when adjusting or storage) (FIGS. 4A-6B). The angle of rotation is controlled by an adjustable bob stay 110 which facilitates vertical movement and luff tension (FIGS. 7A, 7B) while in the sailing mode. The sprit's primary function is to extend the tack position of headsails and spinnakers forward of the bow stem and is effectively horizontal when in the sailing configuration (FIGS. 2A-3B). Said sprit 100 does not clutter deck-space or inhibit crew mobility at the bow area in any way. Said sprit 100 can be rotated to a vertical position when sailing (FIGS. 4A-6B) to facilitate adjustments to the tack of the sail from the safety of the deck area. Crew can reach tack without extension beyond the safety of the lifelines and associated expose to falling overboard. Furthermore the sprit 100 can be rotated to a vertical position which minimizes the LOA and facilitates maneuvering in tight spaces or at the dock, thus resulting in a safer boating experience and lower storage costs.

Figure 7A:
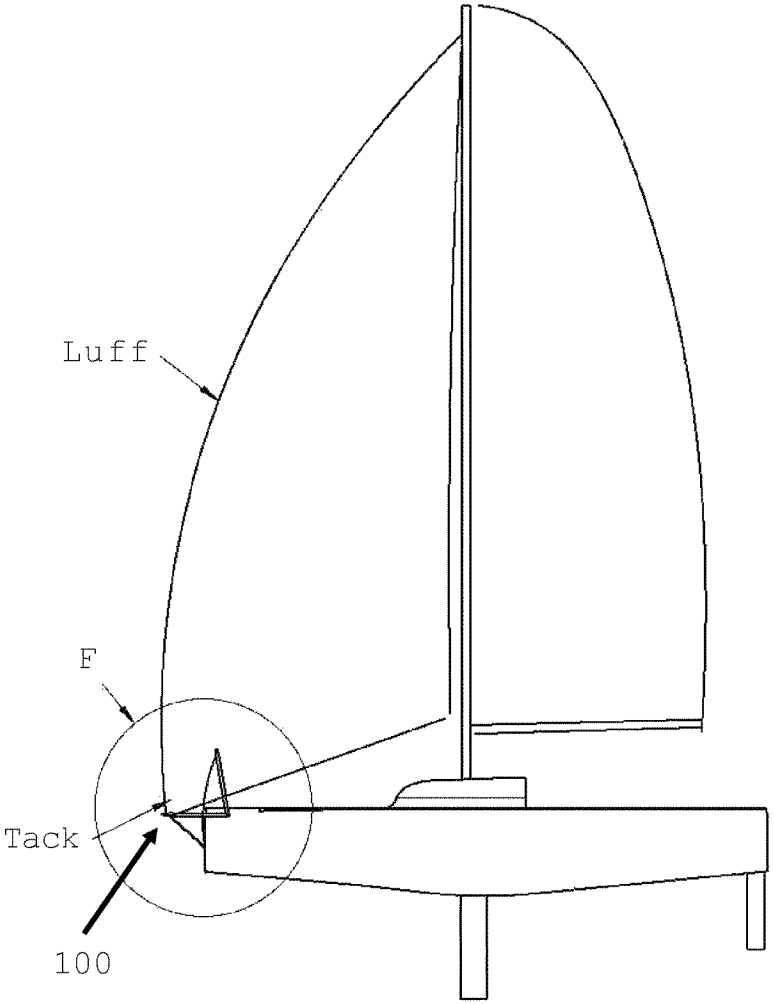
FIG. 7A is a side view of a sail boat incorporating an embodiment of the folding bow sprit of the present invention in the sailing and folded positions.
Figure 7B:
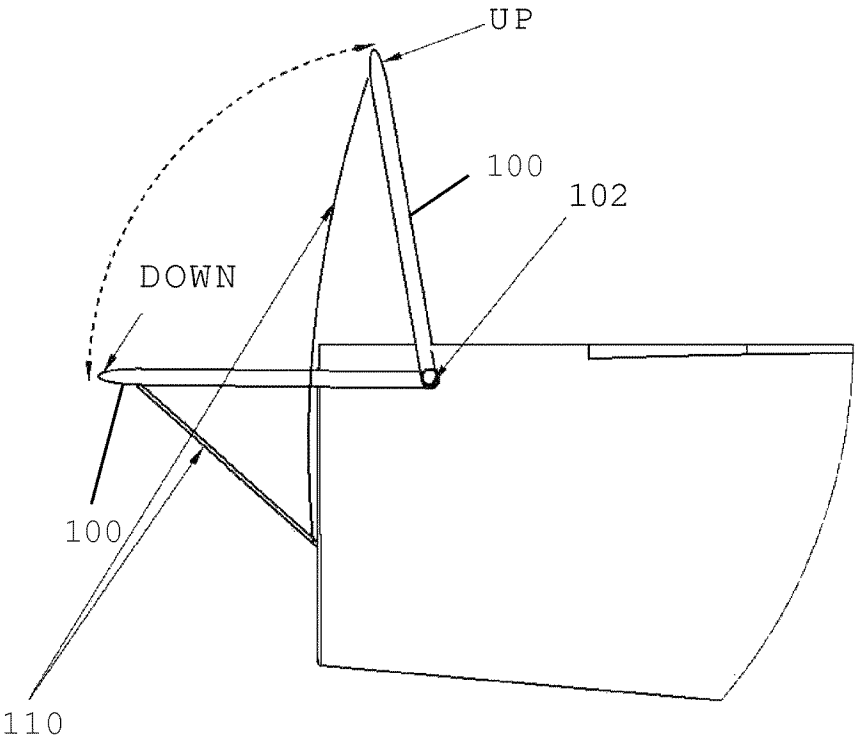
FIG. 7B is a close-up view of detail F of FIG. 7A
Figure 9A:
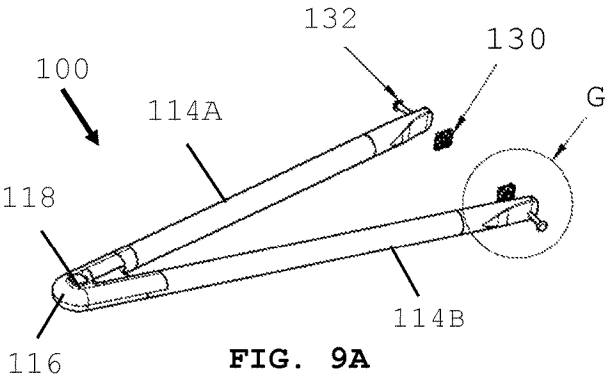
FIG. 9A is an isometric view of the folding bow sprit of the present invention incorporating an alternative hinged bow attachment.
Figure 9B:
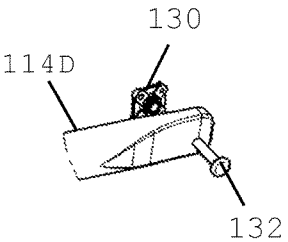
FIG. 9B is a close-up of detail G of FIG. 9A.

The bow sprit 100 of the present invention comprises a "wishbone" configuration of two separate spars 114A, 114B joining the hull just behind the bow at the hinged connection 102 allowing rotation around an axis at ninety degrees to the vessels centerline and permits the forward end of the sprit to move vertically up or down (FIGS. 7A, 7B). The outer/forward ends of the two spars 114A, 114B are joined with an angled connector piece 116 having a vertical connector bushing 118 through the apex (FIG. 8B). The inner ends of the spars 114A, 114B may be connected to shorter end tubes 114C, 114D (FIGS. 8A-8C and 9A-9B), flattened at their inner ends to accommodate the hinged bow attachment 102.

Instead of a fixed bobstay, the sprit 100 has an adjustable bob-stay 110 which permits vertical moment of the sprit 100 up and down which in turn adjusts the luff tension of the attached sail, which is instrumental in achieving correct sail trim in varying conditions.

Instead of one point of attachment as evidenced in telescoping sprits (and associated high loading due to cantilevering), or a two point of connection configuration as evidenced in traditional sprit with bob-stay supported, the folding bowsprit 100 is effectively connected at three points (one 102 at each side of the hull and the third at the bob-stay point of connection 112. These three points of attachment evenly distribute loads over a wide area.

Figure 8A:
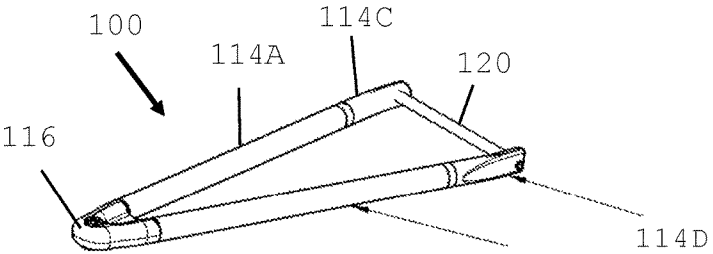
FIG. 8A is an isometric view of the folding bow sprit of the present invention incorporating a first hinged bow attachment.
Figure 8B:
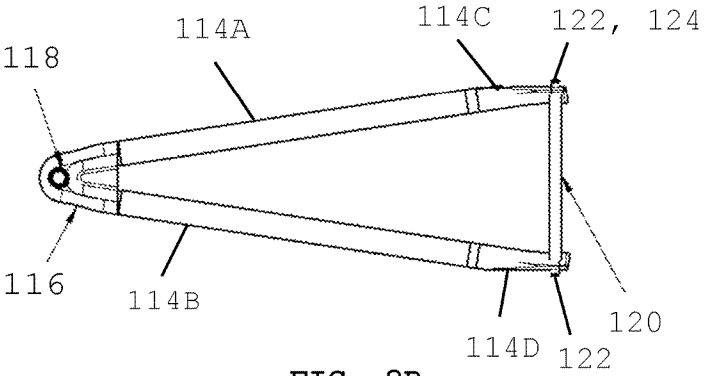
FIG. 8B is a top view of the bow sprit of FIG. 8A.
Figure 8C:
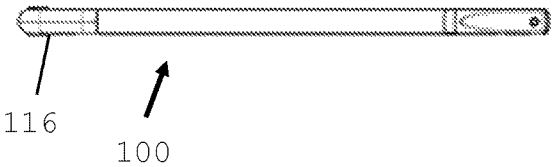
FIG. 8C is a side view of the bow sprit of FIG. 8A.

FIGS. 8A-8C illustrate the folding bow sprit 100 of the present invention incorporating a first hinged bow attachment. The bow attachment includes a hinge tube 120. The hinge tube 120 extends through openings in the sides of the bow. A hinge pin 122 through the hinge tube 120 connects the inner ends of the two spars 114A, 114B and is secured with hinge bolts 124.

9A, 9B illustrate the folding bow sprit 100 of the present invention incorporating an alternative hinged bow attachment. The inner ends of the two spars 114A, 114B are connect to the sides of the bow with self-aligned bearings 130 secured with hinge pins 132.

Consequently structural upgrades to a vessel's hull are typically not required. Loads within the spar members 114A, 114B are carried 100% in compression, which is the most efficient means of transferring loads. This permits smaller sections which are lighter and have less windage. Smaller sections have more subtle visual impact than the massive apparatus in other configurations.

Summarizing:

The folding bowsprit 100 of the present invention comprises wishbone configuration spars 114A, 114B attached to a sailing vessel bow with in a hinged configuration, thus facilitating vertical movement of tack—and controlled by adjustable bob-stay.

The bowsprit 100 has full and continuous movement from a horizontal sailing position to a vertical stowed position and is fully supported by three points of attachment at all times, providing a continuous range of luff tensions and tack heights for varying sailing conditions.

The bowsprit 100 effectively utilizes three points of attachment to reduce sprit sectional sizes and transmitted loads to the points of attachment, thus minimizing hardware weight and associated windage.

The sprit 100 does not impinge on deck-space and facilitates unencumbered movement of the crew on bow deck area.

The sprit 100 facilitates safe and simple adjustments by rotating back within the deck footprint of the vessel for easy access.

The sprit 100 in the vertical position does not extend the length of the vessel, thus simplifying maneuvering in tight quarters and boat storage requirements.

The invention claimed is:

1. A folding bowsprit for a sailing vessel, comprising:

first spar having an outer end and an inner end;

a second spar having an outer end and an inner end;

a hinge tube connecting the inner ends of the first and second spars through the bow of the sailing vessel;

an angled connector piece joining the outer ends of the first and second spar;

an adjustable bob-stay having a first end connected to the angled connector and a second end connected to the bow of the sailing vessel;

whereby the bowsprit is rotatable from a horizontal sailing position to a vertical stowed position.

2. A folding bowsprit for a sailing vessel, comprising:

first spar having an outer end and an inner end;

a first set of self align bearings hingeably connecting the inner end of the first spar to a first side of the bow of the sailing vessel;

a second spar having an outer end and an inner end;

a second set of self align bearings hingeably connecting the inner end of the second spar to a second side of the bow of the sailing vessel;

an angled connector piece joining the outer ends of the first and second spar; and an adjustable bob-stay having a first end connected to the angled connector and a second end connected to the bow of the sailing vessel;

whereby the bowsprit is rotatable from a horizontal sailing position to a vertical stowed position.

* * * * *